US008070511B1

(12) United States Patent
Hsiao

(10) Patent No.: US 8,070,511 B1
(45) Date of Patent: Dec. 6, 2011

(54) HARD DISK DRIVE (HDD) HOT-PLUGGING CONNECTOR

(76) Inventor: Yen-Te Hsiao, Hsinchuang (TW)

( * ) Notice: Subject to any disclaimer, the term of this patent is extended or adjusted under 35 U.S.C. 154(b) by 0 days.

(21) Appl. No.: 12/954,917

(22) Filed: Nov. 29, 2010

(51) Int. Cl.
*H01R 3/00* (2006.01)

(52) U.S. Cl. ..... 439/490; 439/638

(58) Field of Classification Search ..... 439/490, 439/638

See application file for complete search history.

(56) References Cited

U.S. PATENT DOCUMENTS 5,666,453 A * 9/1997 Dannenmann ..... 385/101
6,888,727 B2 * 5/2005 Chang ..... 439/638
7,275,935 B2 * 10/2007 Chen et al. ..... 439/61
7,327,278 B2 * 2/2008 Dannenmann et al. ..... 439/490
2005/0266723 A1 * 12/2005 Graham et al. ..... 439/490
2008/0293290 A1 * 11/2008 Ku et al. ..... 439/490

* cited by examiner

*Primary Examiner* — Briggitte R Hammond
(74) *Attorney, Agent, or Firm* — Leong C. Lei

(57) ABSTRACT

A hot-plugging connector is provided for a hard disk drive (HDD), including an HDD plugging port and a connection port for an SATA cable and a power supply and further includes an HDD plugging indication device having a positive terminal that is supplied with power from a host machine and a negative terminal that is connected to a pin of the connector that is in connection with ah HDD plugging grounding line but is not in direct connection with a grounding line of the host machine. The hot-plugging connector further includes an HDD operation indication device having a positive terminal that is supplied with power from a host machine and a negative terminal that is connected to a pin of the connector that is in connection with an HDD operation grounding line but is not in direct connection with a grounding line of the host computer.

1 Claim, 10 Drawing Sheets

HARD DISK DRIVE (HDD) HOT-PLUGGING CONNECTOR

TECHNICAL FIELD OF THE INVENTION

The present invention generally relates to a hot-plugging connector for a hard disk drive (HDD), and more particularly to an HDD hot-plugging connector that allows visual inspection for identifying if the HDD is properly plugged and in normal operation.

DESCRIPTION OF THE PRIOR ART

Computers are almost a must for daily living of modern people. The computers are often provided with fixed storages, including a hard disk drive (HDD), for storing electronic files and data. These files and data are accumulated in the HDD with a fast increasing rate so that the fixed storages of the computers soon become incapable of storing more data and files. Thus, an additional HDD may be needed. Further, transfer of large files or a great amount of data between separate computers may also need using an independent HDD and traditionally, both the independent HDD and the computers must be powered down before they can be connected or disconnected. This is often referred to as cold-plugging. On the other hand, hot-plugging is also available, which allows for connector or disconnection of an independent HDD from the computers while the computers are being in operation. The hot-plugging is often done with the aid of additional devices. For example, the independent HDD is often installed in a portable HDD case to form a portable HDD, which can then be connected to and/or disconnected from a computer.

To facilitate hot-plugging of an HDD, a hot-plugging connector is provided. The hot-plugging connector comprises an HDD plugging slot and a connection slot for SATA (Serial ATA) cable and power cable.

However, the known hot-plugging connector has a drawback, namely it does not allows for direct identification of proper plugging of the HDD and normal operation of the plugged HDD. This information can only be heretofore identified through using a mouse to check the operation of the computer after the plugging is done. This is certainly inconvenient to the computer users.

SUMMARY OF THE INVENTION

An objective of the present invention is to provide a hot-plugging connector for a hard disk drive (HDD) that allows for easy and direct identification of proper plugging of the HDD and normal operation of the HDD so plugged.

To realize the above objective, the present invention provides an HDD hot-plugging connector, which comprises an HDD plugging port and a connection port for an SATA cable and a power supply and the hot-plugging connector features an indication device having a positive terminal that is supplied with power by a host computer and a negative terminal that is connected to a pin of the connector that is in connection with a plugging grounding line of the HDD but is not in direct connection with a grounding line of the host computer.

Based on the above structure of the present invention, the HDD hot-plugging connector of the present invention is further improved to allow for direct identification of normal operation of an HDD plugged with the connector by the following arrangement:

An indication device is included, having a positive terminal that is supplied with power from a host computer and a negative terminal that is connected to an operation grounding line of the HDD, but is not in direct connection with a grounding line of a host computer.

The positive terminal of the indication device is selectively connected to a resistor for voltage division.

The indication device may comprise one or more light-emitting diodes.

The hot-plugging connector of the present invention comprises an HDD plugging indication device, such as a diode based indicator. The diode based indicator has a positive terminal that is supplied with power from a host computer and a negative terminal that is connected to a pin of the connector that is in connection with an HDD grounding line of the plugging of the HDD but is not in direct connection with a grounding line of the host computer. Since all the grounding lines of the HDD are connected together, the negative terminal can be connected to ground through the plugging so to form a closed loop. When the storage device is plugged, the indicator or an otherwise equivalent indication device is lit. Through the lighting of the indicator or the equivalent indication device, connection of the storage device with the connector can be identified.

In a similar way, when the storage device is to be used, the indicator or the equivalent indication device can be lit up or shut down according to if the storage device is put into operation. Through the lighting of the indicator or the equivalent indication device, normal operation of the storage device can be easily identified.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
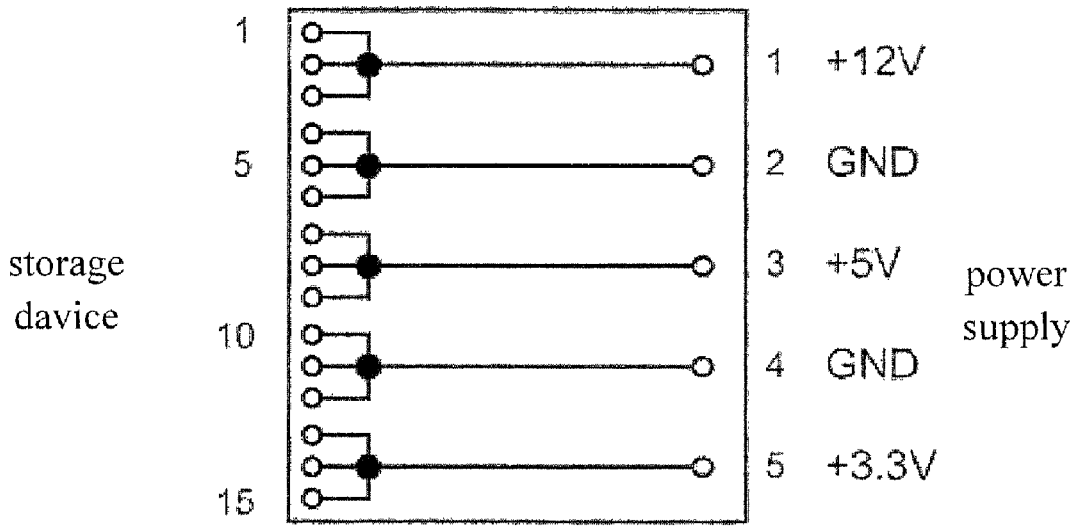
FIG.1 PRIOR ART
FIG. 1 is a circuit diagram of a conventional connector.
Figure 2:
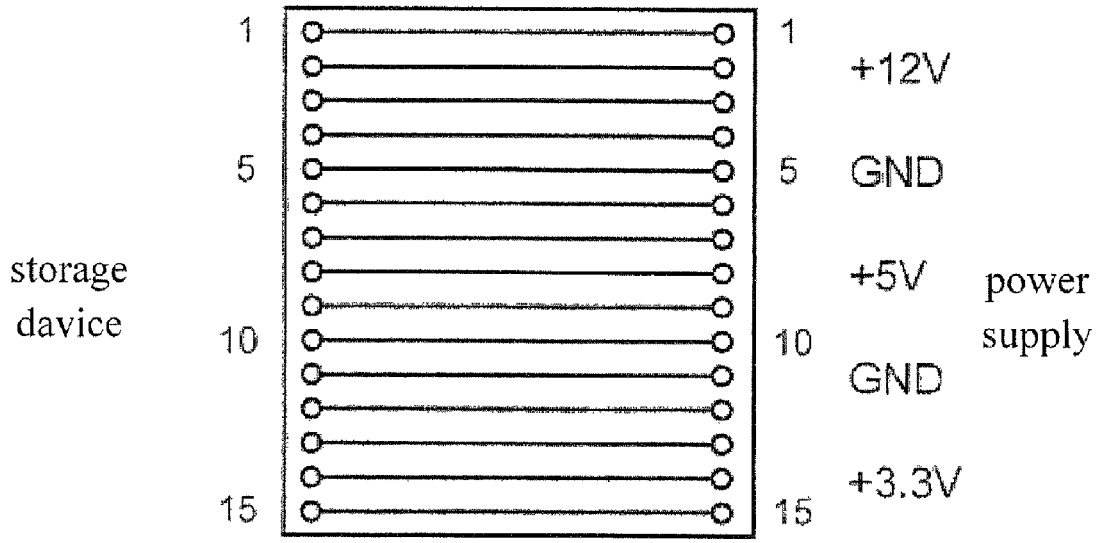
FIG.2 PRIOR ART
FIG. 2 is a circuit diagram of another conventional connector.

FIGS. 1 and 2 respectively show circuit diagrams of conventional connectors. When the conventional connectors are used in plugging a hard disk drive (HDD), a user cannot easily get aware of if the plugging is done well by a simple glance and it is also hardly aware if the plugged HDD is in normal operation.

Figure 3:
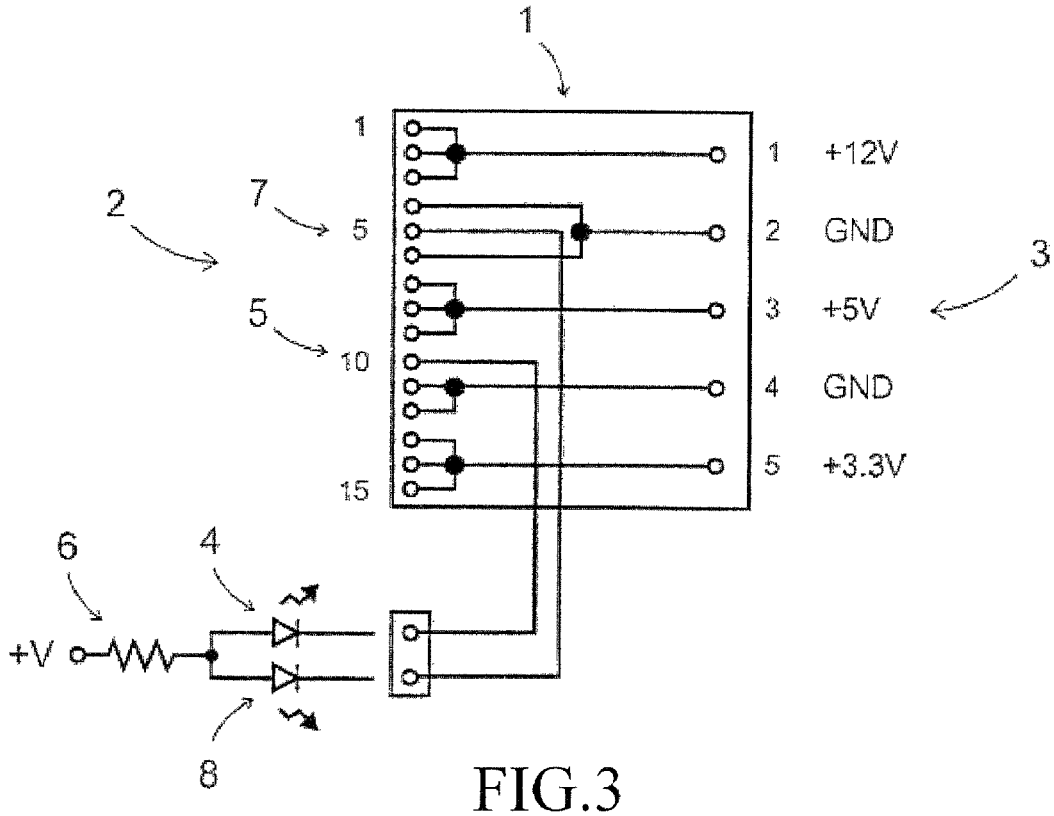
FIG. 3 is a circuit diagram of a hot-plugging connector in accordance with a first embodiment of the present invention.

FIG. 3 shows a circuit diagram of a hot-plugging connector for an HDD in accordance with a first embodiment of the present invention, which shows an improvement over the known circuit of the conventional connector illustrated in FIG. 1. The HDD hot-plugging connector in accordance with the present invention, generally designated at 1, comprises an HDD plugging port 2 and a connection port 3 for an SATA cable 11 and a power supply 9, and is further provided with diode based indicators 4, 8, serving as plugging and operation indication devices. Each diode based indicator has a positive terminal that is supplied with power from a host computer and that may be selectively connected with a voltage division resistor 6. The diode based indicator 4 has a negative terminal that is connected to a pin 5 of the connector that is in connection with a plugging grounding line of the HDD but is not in direct connection with a grounding line of the host computer, while the operation indication device 8 has a negative terminal that is connected to a pin 7 of the connector that is in connection with an operation line of plugging of the HDD but is not in direct connection with a grounding line of the host computer.

Since all the grounding lines of the HDD are connected together and grounded, when the storage device is plugged, the negative terminal of the plugging indication device 4 is connected to the pin 5 of the connector and the grounding line of the plugged HDD and then grounded so as to form a closed loop. The plugging indication device 4 will then be lit and the lighting of the plugging indication device 4 or an otherwise equivalent indication device allows for identification if the storage device is properly installed or plugged.

Similarly, the operation indication device 8 is provided such that the positive terminal thereof is provided with power from the host computer and is selectively connected with a voltage division resistor 6 and the negative terminal is connected to a pin 7 of the connector that is in connection with a operation line of plugging of the HDD but is not in direct connection with a grounding line of the host computer. Thus, when the HDD is set in operation, the operation indication device 8 is lit and through the lighting of the indicator or an otherwise equivalent indication device, normal operation of the storage device can be easily identified.

Figure 4:
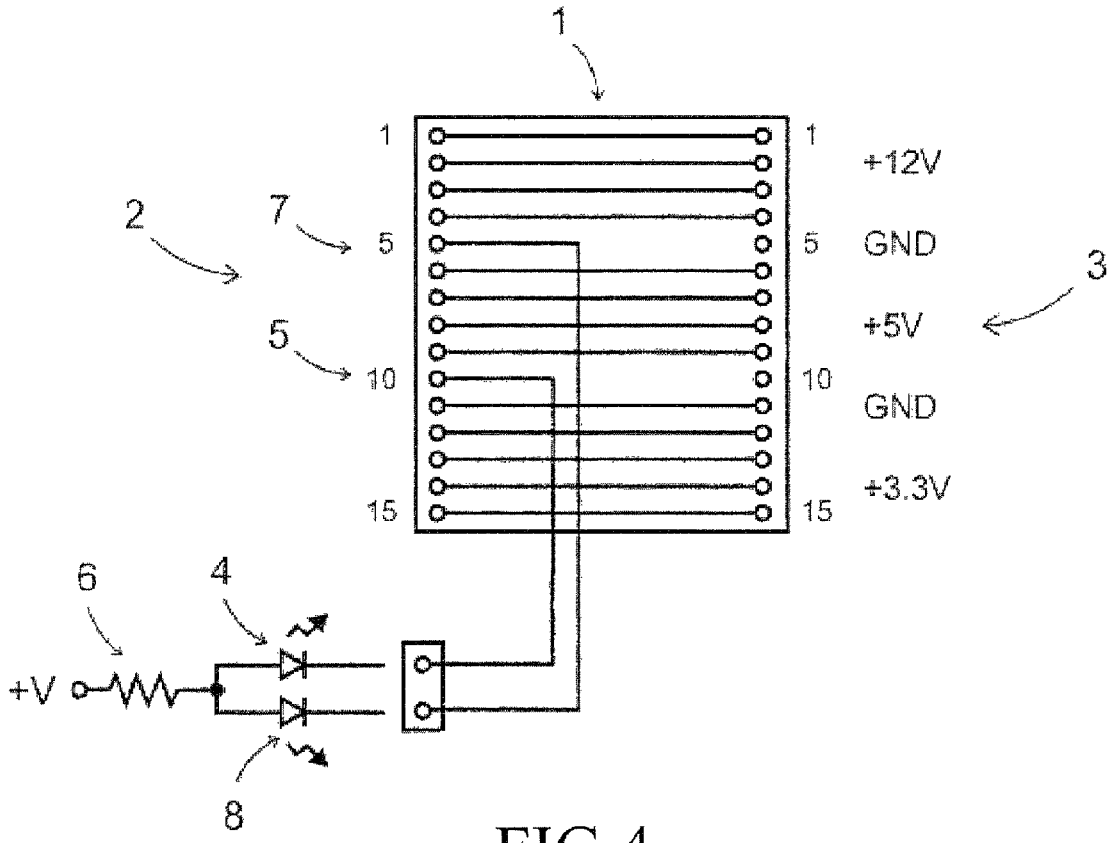
FIG. 4 is a circuit diagram of a hot-plugging connector in accordance with a second embodiment of the present invention.

FIG. 4 shows a second embodiment of the present invention of which the circuit is an improvement of the known connector circuit shown in FIG. 2 and shares the same principle as the first embodiment.

Figure 5:
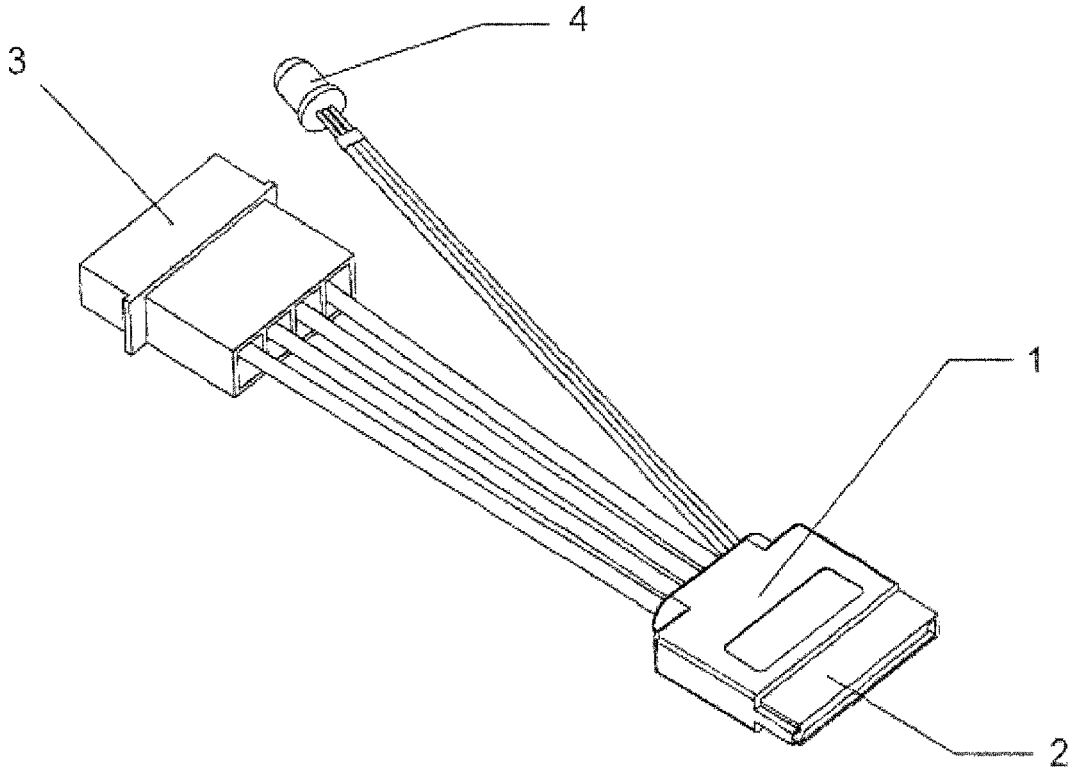
FIG. 5 is a perspective view showing the hot-plugging connector in accordance with the first embodiment of the present invention.
Figure 6:
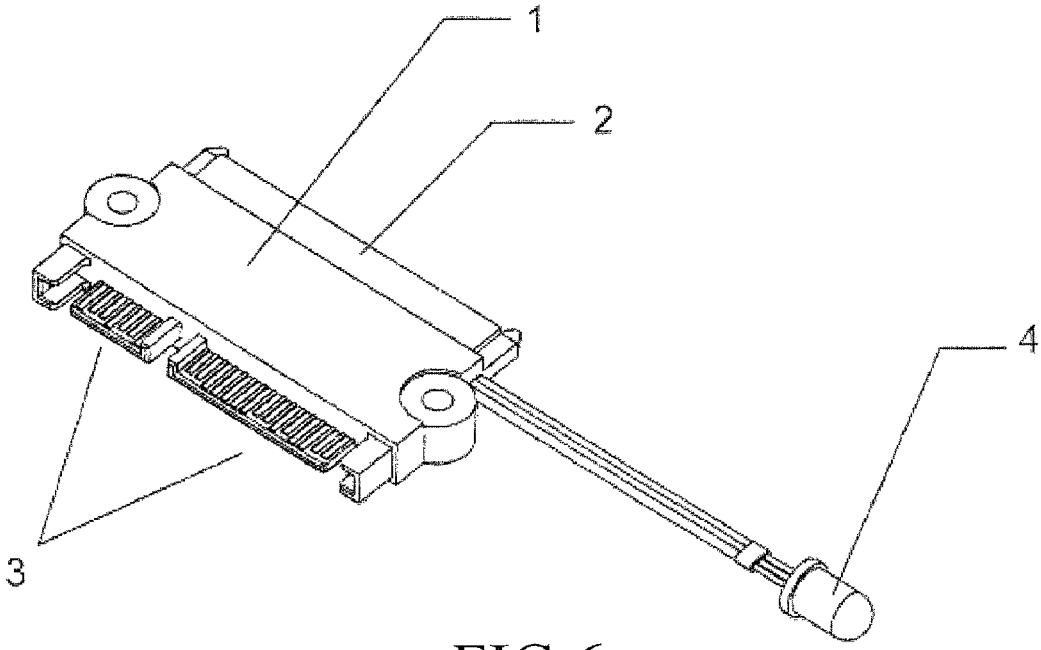
FIG. 6 is a perspective view showing the hot-plugging connector in accordance with the second embodiment of the present invention.

FIGS. 5 and 6 are perspective views respectively showing the first and second embodiments of the hot-plugging connector in accordance with the present invention.

Figure 7:
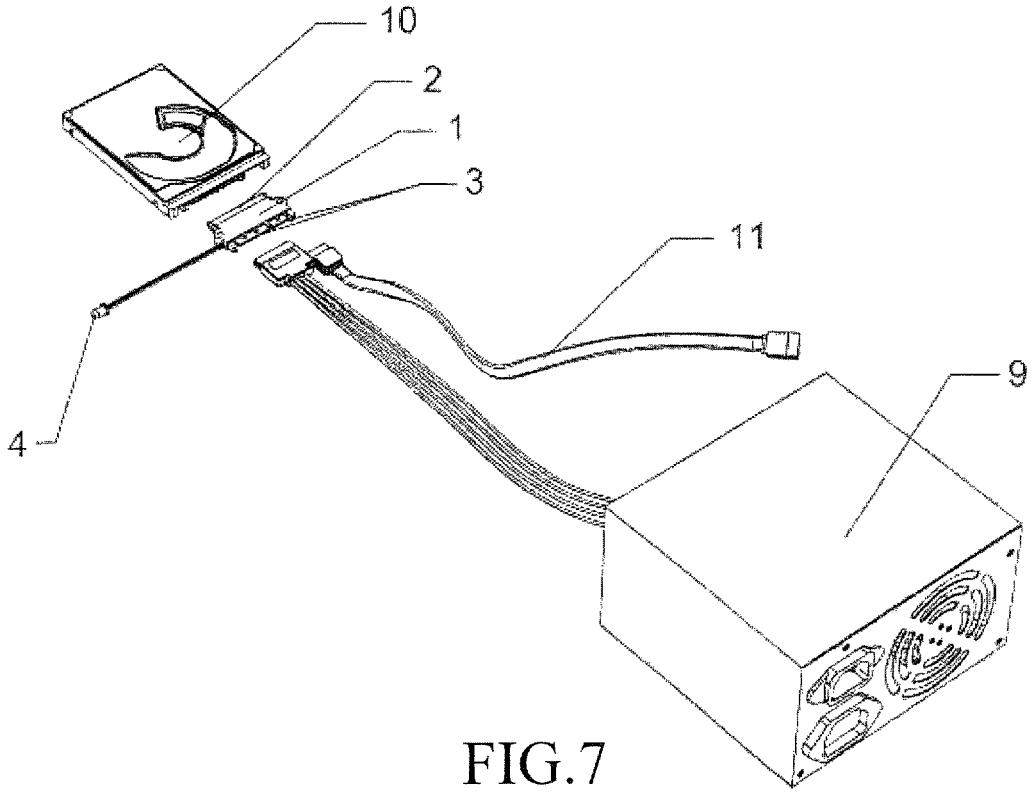
FIG. 7 is a perspective view showing a hot-plugging connector in accordance with a third embodiment of the present invention in a condition of being disconnected from a hard disk drive and a power cable.
Figure 8:
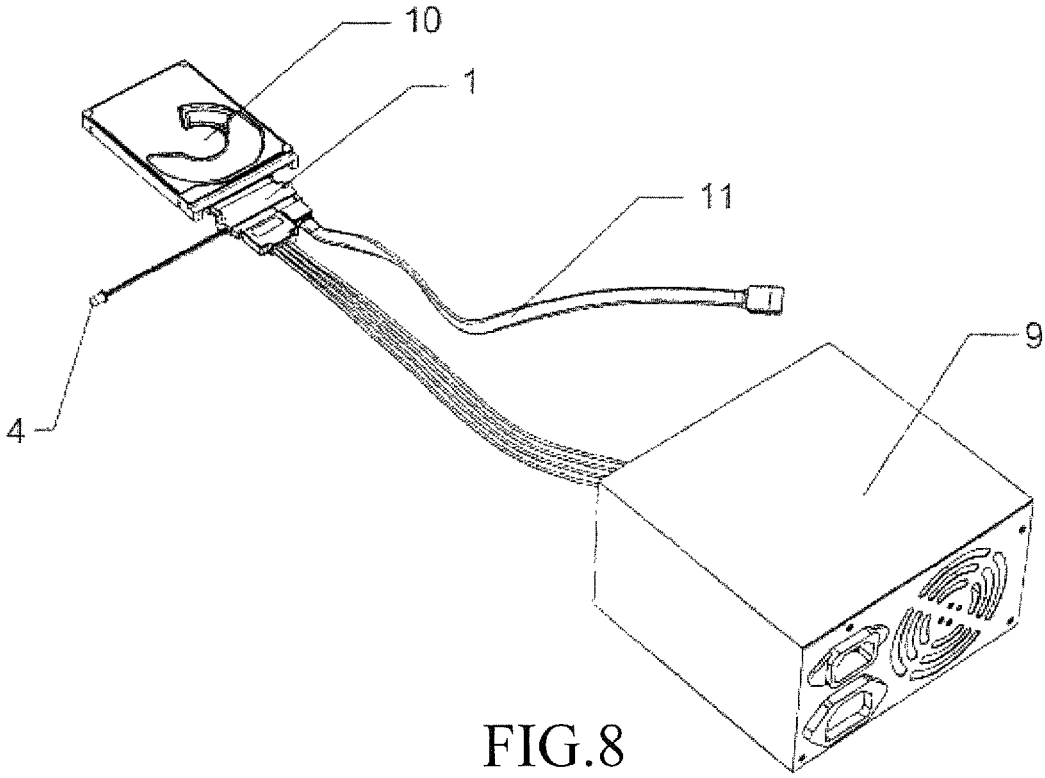
FIG. 8 is a perspective view showing the hot-plugging connector in accordance with the third embodiment of the present invention in a condition of being connected to a hard disk drive and a power cable.

FIGS. 7 and 8 respectively show a third embodiment of the hot-plugging connector of the present invention in a condition of being disconnected from an HDD and in a condition of being connected to the HDD.

Figure 9:
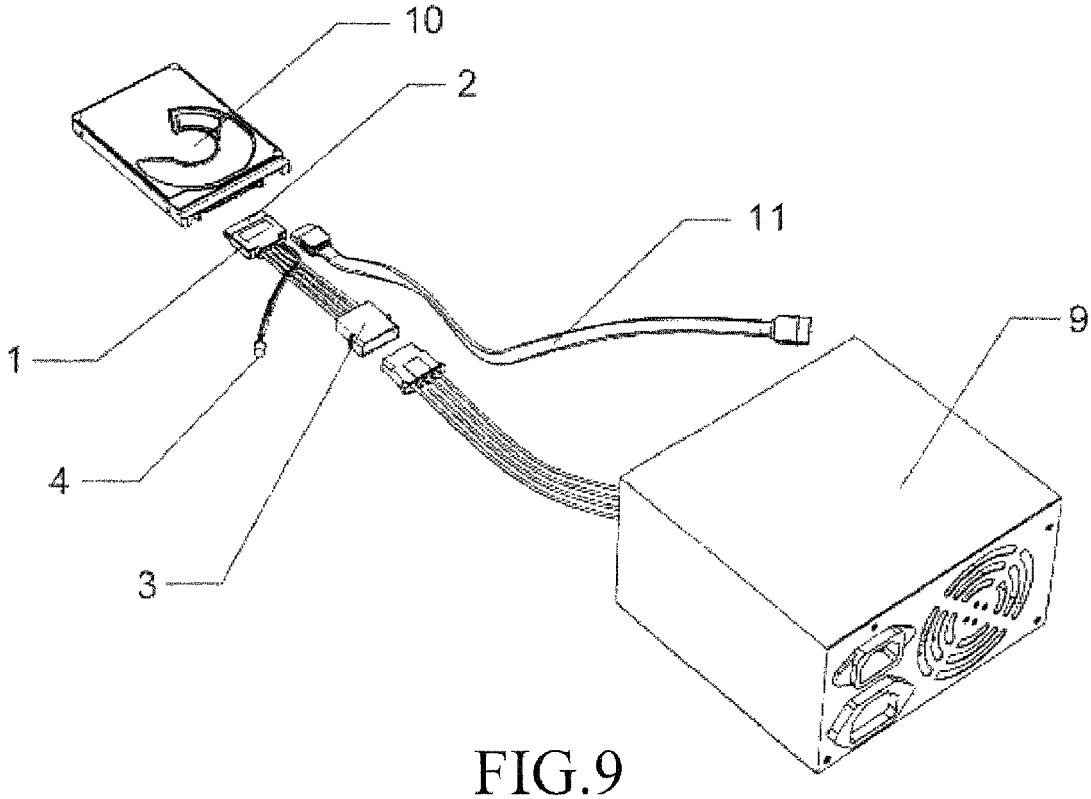
FIG. 9 is a perspective view showing a hot-plugging connector in accordance with a fourth embodiment of the present invention in a condition of being disconnected from a hard disk drive and a power cable.
Figure 10:
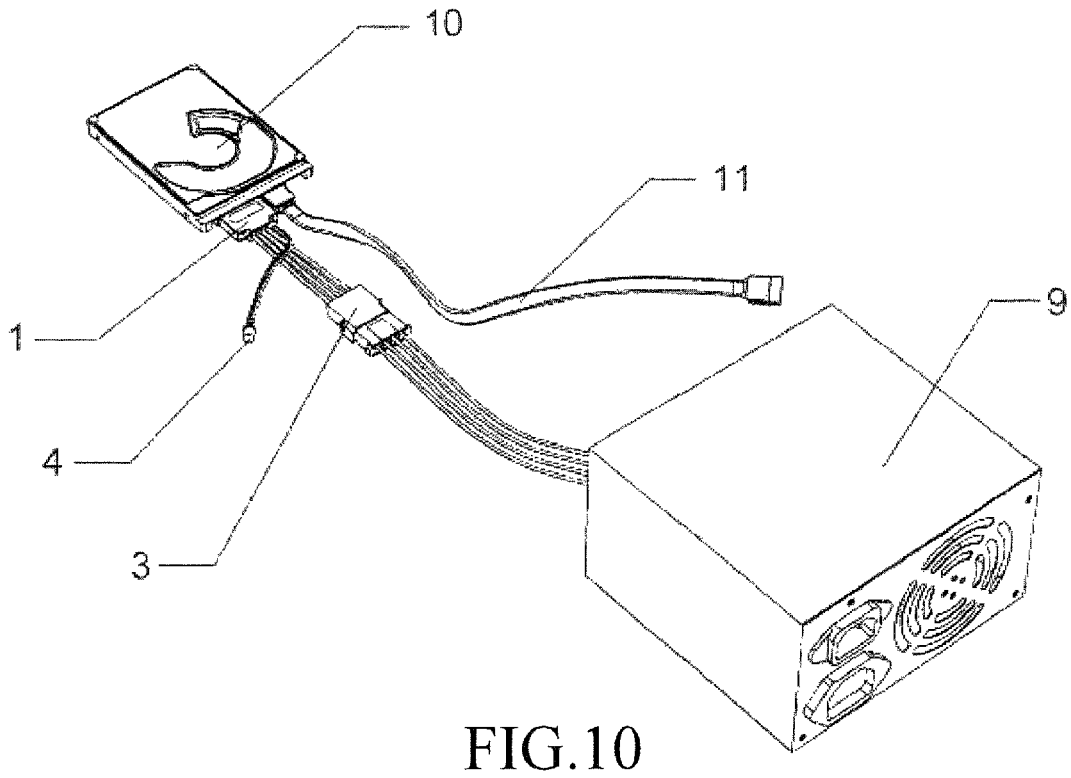
FIG. 10 is a perspective view showing a hot-plugging connector in accordance with a fourth embodiment of the present invention in a condition of being connected to a hard disk drive and a power cable.

FIGS. 9 and 10 respectively show a fourth embodiment of the hot-plugging connector of the present invention in a condition of being disconnected from an HDD and in a condition of being connected to the HDD.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hot-plugging connector for a hard disk drive (HDD) comprising:

an HDD plugging port;

a connection port for an SATA cable and a power supply;

a first diode based indicator having a positive terminal that is supplied power from a host computer and a negative terminal that is connected to a pin of said connector that is in connection with a plugging grounding line of said HDD but is not in direct connection with a grounding line of said host computer; and a second diode based indicator having a negative terminal that is connected to a pin of said connector that is in connection with an operation line of plugging of said HDD but is not in direct connection with a grounding line of said host computer; and each of said first and second diode based indicators having a positive terminal that is selectively connected with a voltage division resistor;

wherein when said HDD is plugged, said negative terminal of said first diode based indicator is connected to said pin of said connector and said grounding line of said plugged HDD and then grounded so as to form a closed loop thereby lighting said first diode based indicator to show that said HDD is properly installed or plugged; when said HDD is set in operation, said second diode based connector is lit to show that said HDD is under normal operation.

* * * * *